US006776595B2

(12) United States Patent
Dewberry

(10) Patent No.: US 6,776,595 B2
(45) Date of Patent: Aug. 17, 2004

(54) TOOL FOR APPLYING GROUT

(75) Inventor: Andrew Terrance Kevin Dewberry, Vancouver (CA)

(73) Assignee: Vancouver Tool Corporation, Vancouver (CA)

( * ) Notice: Subject to any disclaimer, the term of this patent is extended or adjusted under 35 U.S.C. 154(b) by 202 days.

(21) Appl. No.: 10/010,044

(22) Filed: Nov. 30, 2001

(65) Prior Publication Data

US 2003/0104095 A1 Jun. 5, 2003

(51) Int. Cl.[7] ..... B28B 3/02; B05C 17/00

(52) U.S. Cl. ..... 425/78; 425/458; 15/235.4; 401/266

(58) Field of Search ..... 425/87, 458; 15/235.4; 401/9, 266

(56) References Cited

U.S. PATENT DOCUMENTS

| | | | | | |
|---|---|---|---|---|---|
| 2,747,501 A | | 5/1956 | Latimer | 101/114 |
| 3,956,858 A | | 5/1976 | Catlin et al. | 51/394 |
| 4,185,950 A | * | 1/1980 | Lindskog | 425/87 |
| 4,230,356 A | | 10/1980 | O'Connor | 294/19 R |
| 4,919,604 A | * | 4/1990 | Wilson | 425/458 |
| 4,988,272 A | | 1/1991 | Nolan | 425/87 |
| 5,366,116 A | | 11/1994 | Burtis | 222/107 |
| 5,379,479 A | | 1/1995 | Nelson | 15/245.1 |
| 5,471,704 A | | 12/1995 | Woolley | 425/458 |
| 5,611,102 A | | 3/1997 | Lesinsky et al. | 425/458 |
| 5,792,489 A | * | 8/1998 | Liberman | 425/458 |
| D426,444 S | | 6/2000 | Hepworth | D8/90 |
| 6,595,764 B1 | * | 7/2003 | Volk | 425/87 |

FOREIGN PATENT DOCUMENTS

GB 660665 11/1951

OTHER PUBLICATIONS

PCT International Search Report.

* cited by examiner

*Primary Examiner*—Robert Davis
*Assistant Examiner*—Thu Khanh T. Nguyen
(74) *Attorney, Agent, or Firm*—Graybeal Jackson Haley LLP

(57) ABSTRACT

A tool for applying grout into a recess between adjacent tile surfaces comprises a body for gripping by the user formed with an elongate, resilient channel member adapted for retaining a line of grout and delivering the grout directly into the recess by aligning and pressing of the channel member over the recess. A finishing portion can be formed on the same body or a separate body for compressing and shaping the grout after delivery into the recess. The tool of the present invention avoids wasting of grout and increases the speed of application without sacrificing the appearance or integrity of the grout joint.

25 Claims, 7 Drawing Sheets

TOOL FOR APPLYING GROUT

FIELD OF THE INVENTION

This invention relates to tools for applying grout between tiles.

BACKGROUND OF THE INVENTION

Grout is an initially fluid mortar material that is used to fill in the gaps between tiles mounted on an underlying surface. After application in a mouldable state, the grout hardens into a durable, protective and decorative layer between the tiles.

The application of grout between tiles has traditionally been done by applying the grout atop the tiles to be finished and then using a spreading tool such as a trowel to spread the grout in a thin layer over the tiles with the result that grout is deposited in the gaps or recesses between the tiles. The excess grout is then scraped or sponged from the tiles to expose the tile surface. Subsequently, the grout in the recesses is preferably compressed and shaped to form a smooth grouting joint between adjacent tiles. Finishing a tile surface is therefore a labour intensive job that is time consuming and tends to result in wasted excess grout material.

SUMMARY OF THE INVENTION

The present invention is directed to a grout application tool that delivers the grout directly to the recess between the tiles to avoid the need for a trowel tool and scraping of the grout over tile surfaces. The present invention also provides a finishing portion for compressing and shaping the grout to create a smooth and strong grout joint.

Accordingly, the present invention provides a tool for delivering grout into a recess between adjacent tile surfaces comprising:

a body for gripping by the user;

an elongate, resilient channel member on the body adapted for retaining a line of grout and delivering the grout into the recess by aligning and pressing of the channel member over the recess.

The present invention also provides a tool for compressing and shaping grout within a recess comprising:

a body;

a compressing member extending from the body to compress and shape the grout in the recess; and a scraping portion mounted to the body to channel grout into the recess and remove excess grout.

In a further aspect, the present invention provides a combined tool for applying grout into a recess between adjacent tile surfaces comprising:

a body for gripping by the user;

an elongate, resilient channel member on the body adapted for retaining a line of grout and delivering the grout into the recess by aligning and pressing of the channel member over the recess; and a finishing portion on the body for compressing and shaping the grout after delivery into the recess.

The tools of the present invention avoids wasting of grout and increase the speed of application without sacrificing the appearance or integrity of the grout joint.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
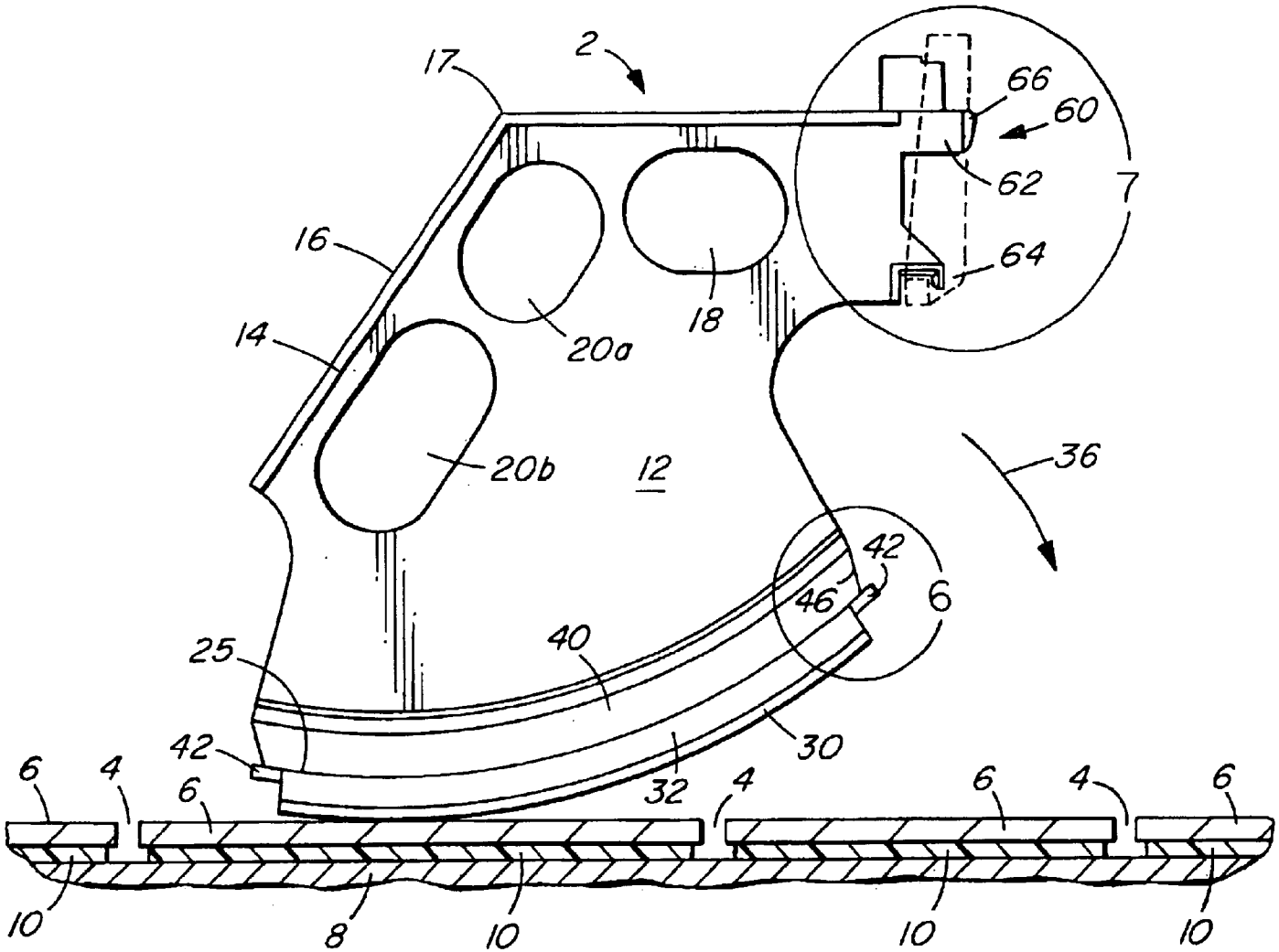
FIG. 1 is a side elevation view of the grout applying tool of the present invention according to a first embodiment.

Referring to FIG. 1, there is shown a tool 2 for applying grout according to a preferred embodiment of the present invention. The preferred embodiment provides a grout applying portion and a grout compressing and shaping portion formed on a single grip or handle. It will be apparent that the portions can be formed on separate grips or handles.

The tool is used to apply grout into the gaps or recesses 4 between adjacent pairs of tiles 6 that are already mounted to an underlying surface 8 by tile adhesive 10. In FIG. 1, tool 2 is aligned over a recess 4 that extends parallel to the plane of the drawing sheet. The other labelled recesses are transverse recesses that extend out of the plane of the sheet.

The tool includes a body 12 adapted for gripping by the hand of a user along a gripping edge 14. Body 12 is preferably a rigid planar sheet of material such a plastic with gripping edge 14 being formed with an angle 17. Edge 14 is also preferably formed with a generally T shaped cross-section. Opening 18 provides a resting place to comfortably locate the user's thumb below and generally parallel to edge 14 on one side of body 12 while openings 20*a* and 20*b* locate the fingers of the handle on the opposite side of the body with the palm of the hand resting atop surface 16 of the T-shaped cross-section.

At the working edge 25 of body 12, there is provided an elongate, resilient channel member 30 adapted for retaining a line of grout and delivering the grout into the recess by the user aligning and pressing the channel member over a recess 4 between tiles 6. Channel member 30 is preferably releasably mountable to body 12 to permit removal for cleaning and replacement.

A finishing portion 60 is also formed on body 12 spaced apart from channel member 30. Finishing portion 60 acts to compress and shape the grout after delivery into recess 4. Preferably, finishing portion 60 is formed on body 12 such that the finishing portion is positioned for use immediately after the channel member delivers grout to the recess as will explained in more detail below.

Figure 2:
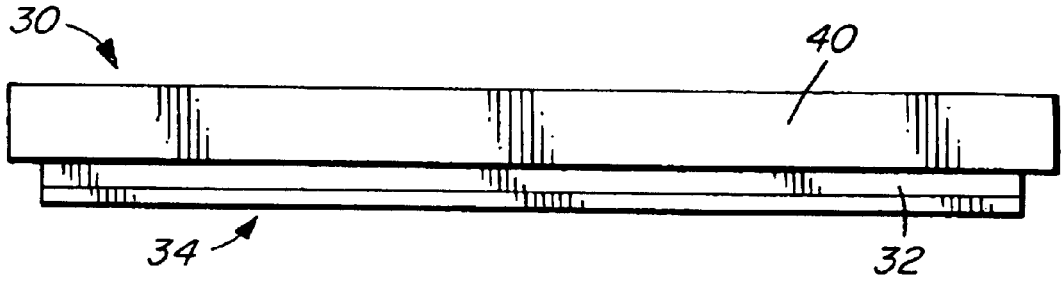
FIG. 2 is a side view of the resilient channel member for applying grout that is removably mountable to the body of the tool.
Figure 3:
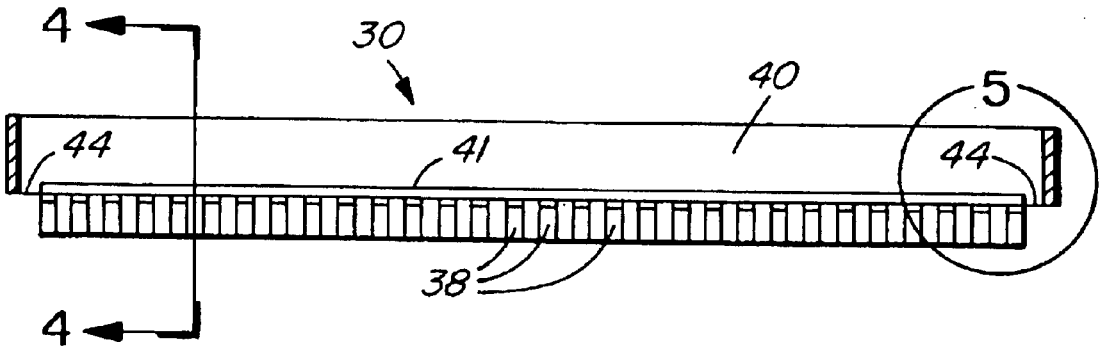
FIG. 3 is a longitudinal cross-section through the resilient channel member showing a preferred band mounting system.
Figure 4:
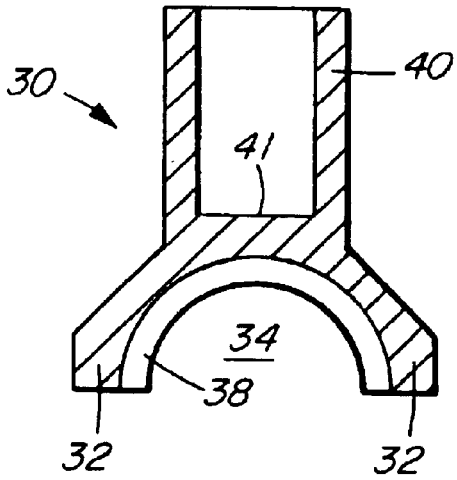
FIG. 4 is a transverse cross-section taken along line 4—4 of FIG. 3 showing the U-shaped channel and the ridges of the channel member.

Referring to FIGS. 2–6, channel member 30 preferably comprises a resilient, elongate member to define a channel to receive grout. A preferred material for the channel member 30 is synthetic rubber. As best shown in FIG. 4, which is a transverse cross-section to the longitudinal axis of the channel member 30, a pair of spaced side walls 32 define an elongate, generally U-shaped cavity 34 which faces away from body 12. Preferably, working edge 25 of body 12 is formed with an arcuate surface which deforms channel member 30 over its length into a corresponding arcuate configuration when mounted to the body. The arcuate shape of channel member 30 allows the user to place a first end of the member over a recess to be filled and gently pivot or rock the body forward in the direction indicated by arrow 36 in FIG. 1 to deposit grout from cavity 34 into recess 4 between the tiles. The user also applies a constant, gentle downward pressure during the rocking motion which acts to seal side walls 32 to the tile surface and deform the side walls slightly to release the grout stored therebetween. The arcuate configuration and resulting motion are desirable to ensure that grout within cavity 34 is readily expelled from the channel into the recess. The downward movement of the channel dislodges the grout from the channel so that the tendency of the grout to stick within the channel is minimized.

To further assist expulsion of the grout from cavity 34, the internal surface of the cavity is preferably formed to be adapted to release the line of grout when compressed over the recess. As best shown in FIG. 3 which is a section view through channel member 30 along its longitudinal axis, the internal surface of cavity 34 is preferably formed with a plurality of spaced, transverse ribs 38 along the length of the channel member. These ribs introduce discontinuities into the surface of cavity 34 so that any tendency of the grout material is stick to the surface and remain in the cavity is minimized.

Channel member 30 can also have a planar linear configuration as illustrated in FIG. 2 when attached to a tool body 12 having a linear working edge 25.

In the illustrated embodiment, channel member 30 is removably mounted to tool body 12 by an elastic band-like mounting arrangement. It will be apparent to a person skilled in the art that alternative mounting schemes are possible such as permanently fastening the channel member 30 to the tool body by gluing, stapling or the like or by releasably mounting using clamping, however, the below-described mounting scheme is preferred based on its simplicity, reliability and ease of operation.

Figure 5:
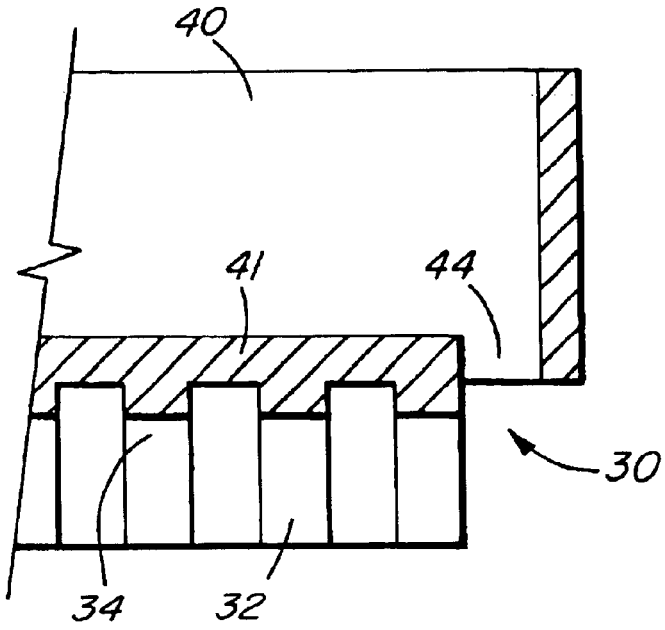
FIG. 5 is a detail view of the indicated portion of FIG. 3 showing the band mounting system of the channel member is section.
Figure 6:
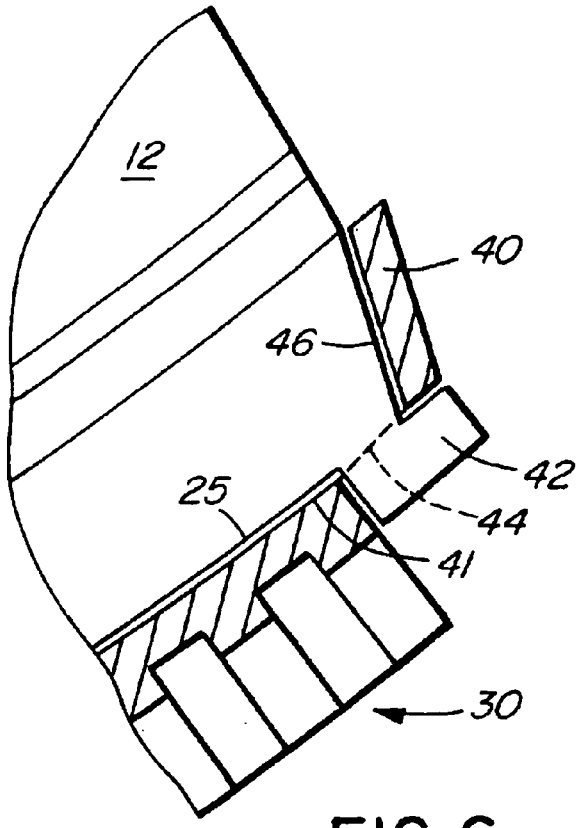
FIG. 6 is a detail view of the indicated portion of FIG. 1 showing the resilient channel member in section mounted to the body of the tool.

The illustrated mounting arrangement for channel member 30 involves forming channel member 30 with an upper closed loop or band 40 adapted to be stretched over at least two anchor points 42 formed on the working edge 25 of body 12. Band 40 extends upwardly from the roof 41 of cavity 34 and is joined to the roof 41 except at the ends of the band where an opening 44 is formed to receive anchor points 42. FIG. 5 is a detail section view of an end of channel member 30 prior to installation on body 2. As best shown in FIG. 6, projection 42 comprises a short flange extending forwardly or rearwardly for working edge 25. To install channel member 30 on body 12, projection 42 is inserted through the interior of band and through opening 44 at one end of the band into the position shown in FIG. 6. Band 40 is thereby wrapped about face 46 of body 12 and roof 41 of cavity 34 abuts against working edge 25. The other end of band 40 is then stretched to insert the other projection 42 through opening 44 at the other end of the channel member to releasably couple the channel member to the body. Resilient channel member 30 is mounted adjacent arcuate working edge 25 surface which imparts an arcuate shape to the channel member over its length.

Figure 11:
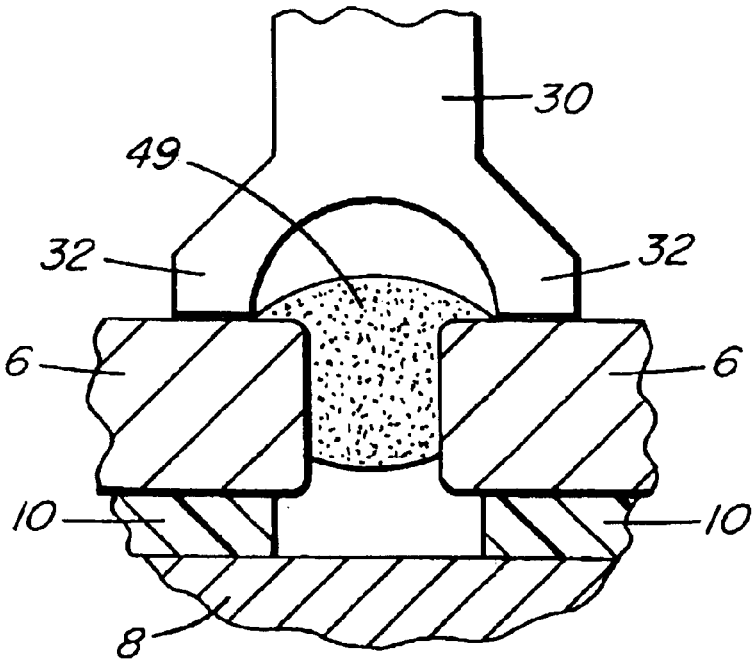
FIG. 11 is a cross-sectional view through a recess between two tiles showing the grout after application by the resilient member.

In use, the body 12 is initially inverted to allow a user to place a line of flowable grout from a grout supply within channel 34. The tool is then placed over a recess 4 with grout filled channel 34 facing downwardly as shown in FIG. 1. Referring to FIG. 11, channel member 30 is positioned such that the channel side walls 32 straddle the recess and abut against the upper surfaces of the adjacent tiles 6 whose edges define the recess. The grout will tend to remain in channel 34 until the user applies gentle pressure against the tile surfaces to deform channel side walls 32 outwardly slightly to release the grout into recess 4. In the case of a channel member that is formed into an arcuate configuration, the user also pivots or rocks the tool about the arcuate channel member 30 as pressure is applied. After the grout is released into recess 4, it will tend to assume the domed shape 49 shown in FIG. 11 which is a cross-section taken through the recess. Note that the applied grout is essentially confined to the recess and is not spread over the upper surfaces of the tile as in conventional grout applying techniques.

Figure 8:
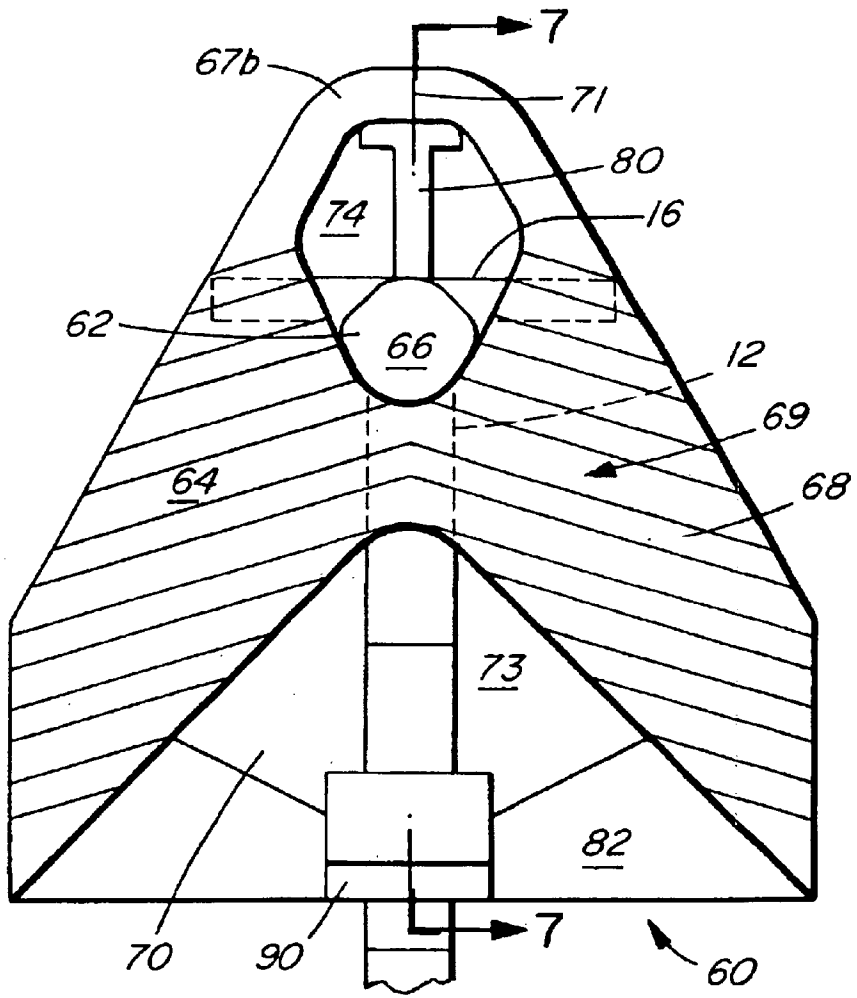
FIG. 8 is a front elevation of the finishing portion of the tool with the resilient member installed.
Figure 7:
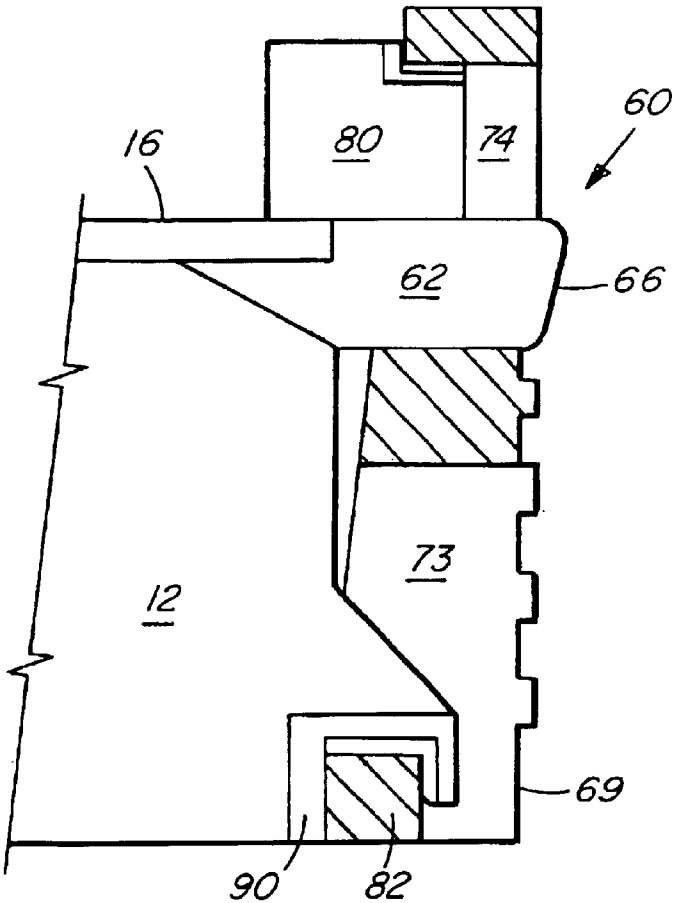
FIG. 7 is a detail view of the indicated portion of FIG. 1 taken along line 7—7 of FIG. 8 showing the finishing portion of the tool in partial section.
Figure 9:
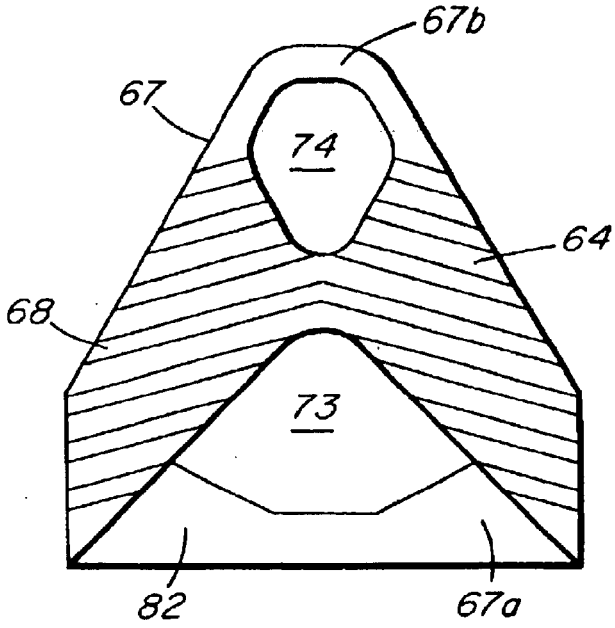
FIG. 9 shows the resilient member of the finishing portion dismounted from the body of the tool.

FIGS. 7–9 show the finishing portion 60 of the tool of the present invention for compressing and shaping the grout 49 just applied to recess 4. FIG. 7 is a detail view of the indicated portion of FIG. 1 and FIG. 8 is a front elevation view of the finishing portion. Finishing portion 60 includes a compressing member 62 adapted to be inserted into recess 4 to compress and shape the grout in the recess and a scraping portion 64 to channel grout into the recess and remove excess grout.

Compressing member 62 is preferably in the form of a projecting post extending from body 12 having a distal end surface 66 to engage the grout on dragging of the finishing portion along the freshly deposited line of grout. Distal surface 66 is preferably angled to present a profile that decreases in thickness in the direction of movement of the finishing portion 60. Surface 66 is also generally convex in cross-section in a plane transverse to the direction of movement to impart a concave shape to the grout in the recess.

Surrounding distal end surface 66 is a resilient, generally triangular member 67 extending between a flat base 67*a* and a rounded apex 67*b* that defines scraping portion 64. Triangular member 67 includes a face 69 adapted to engage and scrape across the upper surfaces of the tiles adjacent recess 4. Face 69 is preferably formed with a pattern of angled ridges 68 symmetric about centre line 71 that act to direct grout on the upper tile surface toward recess 4 as the face is dragged over the tile surfaces along a recess. The base 67*a* of triangular member 67 is formed with a generally V-shaped passage 70 which also acts to collect and direct grout into the recess.

At least one opening extends through face 69 to receive excess grout and direct the grout away from the resilient surface. In the illustrated embodiment, a first opening 73 communicates with V-shaped passage 70 and a second opening 74 is formed adjacent the apex 67*b*. Second opening 74 is positioned to receive and retain compressing and shaping member 62 when the triangular member is mounted in place on body 12. Second opening 74 provides a passage through which the compressing and shaping member protrudes to engage the grout.

Triangular member 67 is preferably removably mounted to body 12 for ease of cleaning and replacement. FIG. 9 shows triangular member 67 dismounted from body 12. Referring to FIG. 7, body 12 is formed with an upper bracket 80 and a lower bracket to retain triangular member 67 on the body. Bracket 90 is inserted through opening 73 to engage against lower strip 82 extending between the side walls of V-shaped passage 70 adjacent base 67*a*. Bracket 80 and projection 62 are inserted through opening 74 to retain the apex 67*b* of triangular member 67 in place. Compressing and shaping surface 66 is positioned to extend below the plane of scraping face 69.

Figure 10:
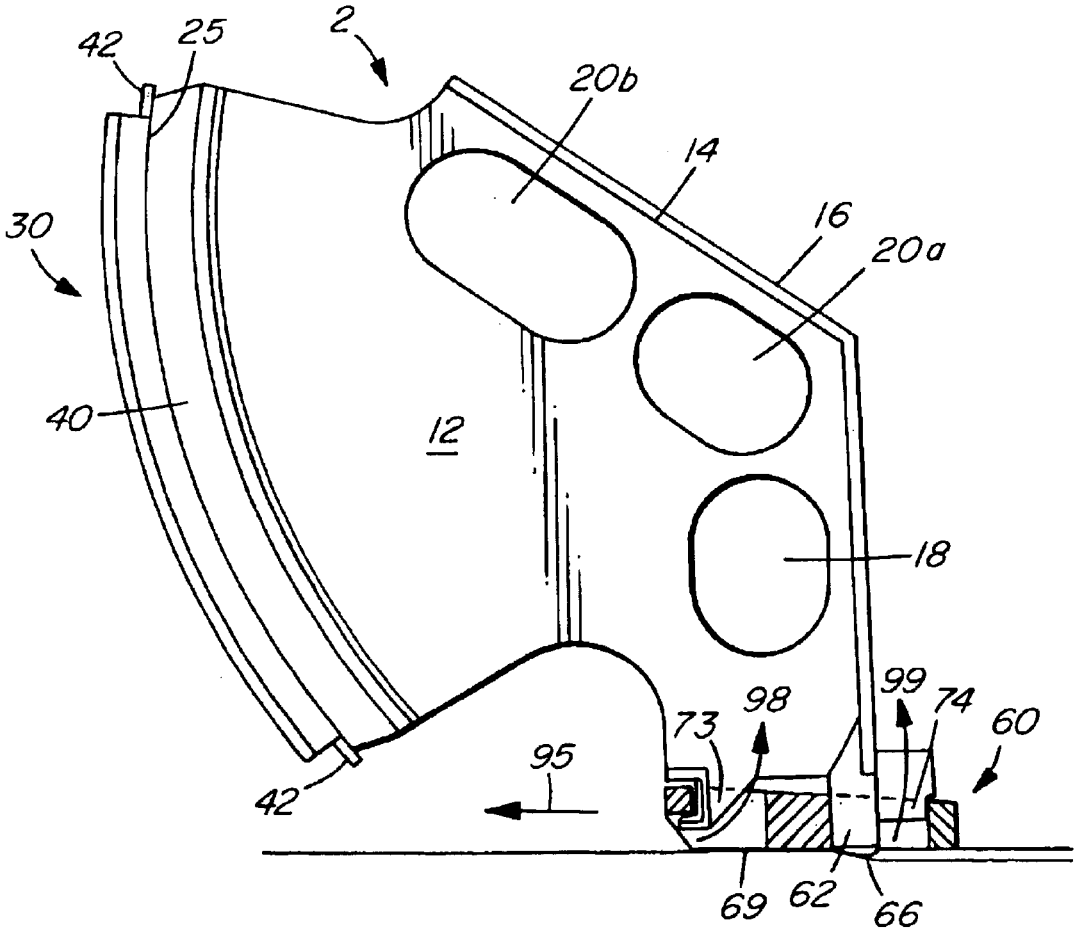
FIG. 10 shows the tool of the present invention oriented to compress and finish a grout line.
Figure 12:
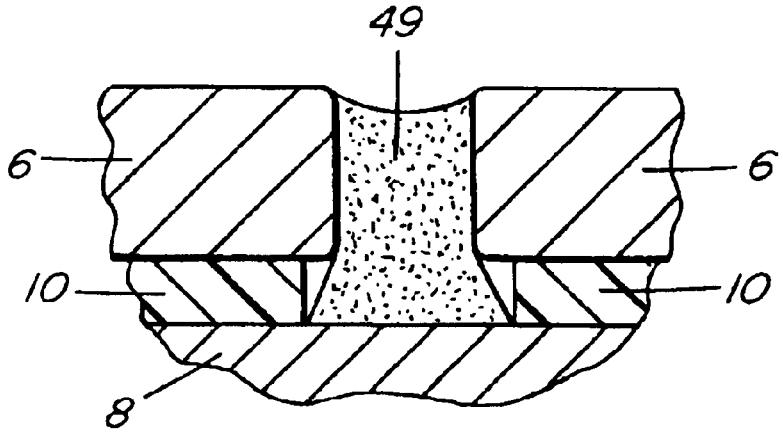
FIG. 12 is a cross-section view through a recess between two tiles showing the grout after compressing and shaping by the finishing portion.

FIG. 10 shows the manner in which finishing portion 60 is used. After channel member 30 is positioned over a recess between tiles and pressed and pivoted to deliver grout into the recess, finishing portion 60 is automatically oriented for use. Surface 69 is pressed onto the tiles surfaces such that projecting compressing and shaping surface 66 extends into recess 4. The tool is then pulled toward the user in a smooth stroke in the direction of arrow 95 in FIG. 10. V-shaped channel 70 and ridges 68 on surface 69 act to collect and direct any excess grout on the surface of the tiles into recess 4 for compression and shaping by protruding surface 66. Any excess grout is directed through openings 73 and 74 as indicated by arrows 98 and 99. The small amount of excess grout that collects is cleaned from the body preferably after each stroke of the tool. FIG. 12 illustrated the finished appearance of grout 49 after compressing and shaping by finishing portion 60.

Figure 13:
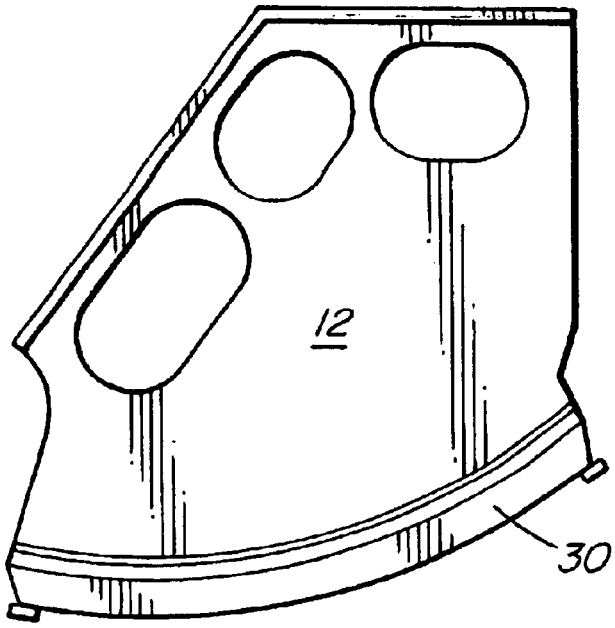
FIG. 13 is a side elevation view of the tool according to a second embodiment that includes only the channel member.
Figure 14:
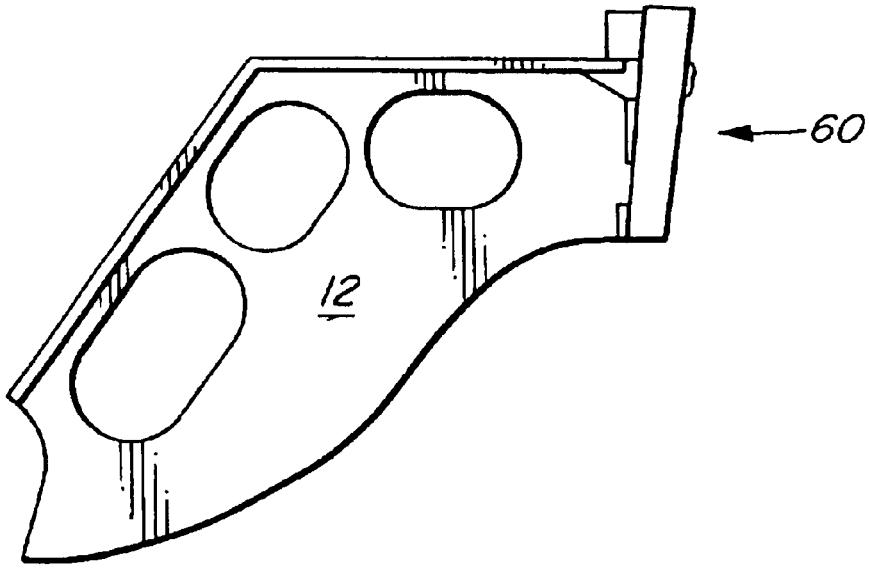
FIG. 14 is a side elevation view of the tool according to a third embodiment that includes only the finishing portion.

The tool of the present invention has been illustrated in FIGS. 1–10 as having both a grout applying portion and a grout compressing and finishing portion attached to a single body or handle, however, the portions can be formed on separate bodies and used independently. FIG. 13 illustrates a second embodiment of the invention in the form of a grout applying tool that includes the previously described channel member 30. FIG. 14 illustrates a third embodiment which is useful as a grout compressing and finishing tool that includes the finishing portion 60 described above.

Although the present invention has been described in some detail by way of example for purposes of clarity and understanding, it will be apparent that certain changes and modifications may be practised within the scope of the appended claims.

I claim:

1. A tool for applying grout into a recess between adjacent tiles surfaces comprising:

a body for gripping by the user;

an elongate, resilient channel member on the body having a pair of spaced side walls that define an elongate cavity facing away from the body to receive a line of grout, said channel member being adapted for retaining the line of grout and delivering the grout into the recess by aligning and pressing the channel member over the recess; and a finishing portion on the body for compressing and shaping the grout after delivery into the recess.

2. A tool as claimed in claim 1 in which the channel member is mountable to the body to extend in an arcuate configuration over the length of the channel member.

3. A tool as claimed in claim 1 in which the cavity is generally U-shaped in cross-section.

4. A tool as claimed in claim 1 in which the cavity is formed with an internal surface adapted to release the line of grout when compressed over the recess.

5. A tool as claimed in claim 4 in which the internal surface is formed with a plurality of spaced, transverse ribs along the length of the channel member.

6. A tool claimed In claim 1 which the channel member is mountable to the body by a mount arrangement comprising:

at least two anchor points formed on the body; and a resilient band formed on channel member adapted to be stretched about the anchor points to retain channel member against the body.

7. A tool am claimed claim 6 in which the body includes an arcuate surface extending between the at least two her points and the resilient channel member is mounted via the resilient band adjacent the arcuate surface which imparts an arcuate shape to the channel member over the length of the channel member.

8. A tool as claimed in claim 1 in which the body includes an arcuate surface and the resilient channel member is mounted adjacent the arcuate surface which imparts an arcuate shape to the channel member over the length of the channel member.

9. A tool claimed in claim 1 in which the channel member is made from rubber.

10. A tool claimed in claim 1 in which the channel member and the finishing portion are arranged on different regions of the body such that the finishing portion is positioned for use after the channel member delivers grout to the recess.

11. A tool as claimed in claim 1 in which the finishing portion comprises:

a compressing member to compress and shape the grout in the recess;

a scraping portion to channel grout into the recess and remove excess grout.

12. A tool as claimed in claim 11 in which the compressing member comprises a projection extending from the body having a distal end surface to compress and shape the grout in the recess on dragging of the finishing portion along the recess.

13. A tool as claimed in claim 11 in which the scraping portion includes a resilient surface engage the tile.

14. A tool as claimed in claim 13 including ridges formed on the resilient surface to direct grout toward the recess on dragging of the resilient surface along the recess.

15. A tool as claimed in claim 13 in which the resilient surface includes a generally V-shaped passage adapted to collect and direct grout into the recess.

16. A tool as claimed in claim 13 in which the resilient surface includes at least one opening to receive excess grout and direct the grout away from the resilient surface.

17. A tool as claimed in claim 11 in which the scraping portion comprises a resilient member adapted to be releasably mourned to the body, the resilient member having a resilient surface to direct grout to the recess, a generally V-shaped passage adapted to collect mid direct grout in the recess and at least one opening therethrough to receive excess grout and direct the grout away from the resilient surface.

18. A tool as claimed in claim 17 in which the resilient member is formed with two openings adjacent the V-shaped passage.

19. A tool for delivering grout into a recess between adjacent tile surfaces comprising:

a body for gripping the user;

an elongate, resilient channel member on the body having a pair of spaced side walls that define an elongate facing away from the body, said channel member being adapted for retaining a line of grout and delivering grout into the recess by aligning and pressing of the channel member over the recess.

20. A tool as claimed in claim 19 including a finishing portion on the body for compressing and shaping the grout after delivery into the recess.

21. A tool for applying grout into a recess between adjacent tile surfaces comprising:

a body for gripping by the user, and an elongate, resilient channel member on the body adapted for retaining a line of grout and delivering the grout into the recess by aligning and pressing of the channel member over the recess wherein the body includes in arcuate surface and the resilient channel member is mounted adjacent the arcuate surface which imparts an arcuate shape to the channel member over the length of the channel member.

22. A tool as claimed in claim 21 including a finishing portion on the body for compressing and shaping the grout after delivery into the recess.

23. A tool for applying grout into a recess between adjacent tile surfaces comprising:

a body for gripping by the user;

an elongate, resilient channel member on the body adapted for retaining a line of grout and delivering the grout into the recess by aligning and pressing of the channel member over the recess;

a finishing portion on the body for manipulating the grout after delivery into the recess having a compressing member to compress and shape the grout in the recess and a scraping portion to channel grout into the recess and remove excess grout, the scraping portion including a resilient surface to engage the tile.

24. A tool as claimed in claim 23 in which the scraping portion comprises a resilient member adapted to be releasably mounted to the body, the resilient member being formed with the resilient surface to direct grout to the recess, a generally V-shaped passage adapted to collect and direct grout in the recess and at least one opening therethrough to receive excess grout and direct the grout away from the resilient surface.

25. A tool as claimed in claim 23 in which the compressing member comprises a projection extending from the body having a distal end surface to compress and shape the grout in the recess on dragging of the finishing portion along the recess.

* * * * *

UNITED STATES PATENT AND TRADEMARK OFFICE

CERTIFICATE OF CORRECTION

PATENT NO. : 6,776,595 B2 
DATED : August 17, 2004
INVENTOR(S) : Andrew Terrance Kevin Dewberry It is certified that error appears in the above-identified patent and that said Letters Patent is hereby corrected as shown below:

Column 6,
Lines 9-11, should read: -- A tool as claimed in claim 1 in which the channel member is mountable to the body by a mounting arrangement comprising: --
Lines 13-14, should read: -- a resilient band formed on the channel member adapted to be stretched about the anchor points to retain the channel --
Lines 16-17, should read: -- A tool as claimed in claim 6 in which the body includes an arcuate surface extending between the at least two anchor --
Line 28, should read: -- A tool as claimed in claim 1 in which the channel --
Line 45, should read: -- portion includes a resilient surface to engage the tile. --
Line 57, should read: -- ably mounted to the body, the resilient member having a --
Line 59, should read: -- V-shaped passage adapted to collect and direct grout in the --

Column 7,
Line 1, should read: -- a body for gripping by the user; --
Line 3, should read: -- a pair of spaced side walls that define an elongate cavity --
Line 6, should read: -- the grout into the recess by aligning and pressing of the --
Line 18, should read: -- includes an arculate surface and the resilient channel --

Signed and Sealed this

Fifth Day of April, 2005

JON W. DUDAS
*Director of the United States Patent and Trademark Office*